US011920341B2

(12) United States Patent
Gstach et al.

(10) Patent No.: US 11,920,341 B2
(45) Date of Patent: Mar. 5, 2024

(54) PROFILE RAIL WITH REINFORCING ELEMENT

(71) Applicant: Hilti Aktiengesellschaft, Schaan (LI)

(72) Inventors: Peter Gstach, Bludesch (AT); Philipp Grosser, Buchs (CH); Andrin Nigg, Triesen (LI); Daniele Casucci, Buchs (CH); Bernhard Winkler, Feldkirch (AT)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 17/672,833

(22) Filed: Feb. 16, 2022

(65) Prior Publication Data

US 2022/0170261 A1 Jun. 2, 2022

Related U.S. Application Data

(63) Continuation of application No. 16/633,698, filed as application No. PCT/EP2018/069992 on Jul. 24, 2018, now Pat. No. 11,286,661.

(30) Foreign Application Priority Data

Aug. 1, 2017 (EP) ..... 17184148

(51) Int. Cl.
*E04B 1/41* (2006.01)
*E04B 1/04* (2006.01)
(Continued)

(52) U.S. Cl.
CPC ..... *E04B 1/4107* (2013.01); *E04C 5/00* (2013.01); *E04B 1/043* (2013.01); *E04B 1/21* (2013.01);
(Continued)

(58) Field of Classification Search
CPC ..... E04B 1/4107; E04B 2001/4192; E04B 1/4114; E04B 1/4135; E04B 1/043;
(Continued)

(56) References Cited

U.S. PATENT DOCUMENTS 4,073,114 A 2/1978 Irish
5,357,721 A 10/1994 Alvarez et al.
(Continued)

FOREIGN PATENT DOCUMENTS

CN 106049689 A 10/2016
DE 2026602 A1 12/1971
(Continued)

OTHER PUBLICATIONS

International Search Report of PCT/EP2018/069992, dated Sep. 25, 2018.
(Continued)

*Primary Examiner* — Theodore V Adamos
(74) *Attorney, Agent, or Firm* — Davidson, Davidson & Kappel, LLC

(57) ABSTRACT

A rail assembly is provided, suitable for embedding in concrete, including a profile rail having a rail body, wherein the rail body has a first lateral wall, a second lateral wall, a first rail lip protruding from the first lateral wall, and a second rail lip protruding from the second lateral wall. The rail assembly has a reinforcing element with a force-absorbing body, wherein the force-absorbing body is positioned in front of the first lateral wall of the profile rail for contacting the first lateral wall of the profile rail with the force-absorbing body. A construction body having a concrete element, in which a rail assembly of this type is embedded is also provided, as is a method.

17 Claims, 4 Drawing Sheets

(51) Int. Cl.
*E04B 1/21* (2006.01)
*E04C 5/00* (2006.01)
*E04G 21/14* (2006.01)

(52) U.S. Cl.
CPC .... *E04B 2001/4192* (2013.01); *E04G 21/142* (2013.01)

(58) Field of Classification Search
CPC ..... E04B 1/21; E04C 5/00; E04C 5/12; E04G 21/142
See application file for complete search history.

(56) References Cited

U.S. PATENT DOCUMENTS

| | | | | |
|---|---|---|---|---|
| 8,635,832 | B2 | 1/2014 | Heudorfer | |
| 8,701,358 | B1 | 4/2014 | Bethlendy, Jr. | |
| 9,097,004 | B2 | 8/2015 | Yau | |
| 9,394,681 | B2 | 7/2016 | Brunhuber et al. | |
| 9,840,838 | B2 | 12/2017 | Heudorfer et al. | |
| 9,938,709 | B2 | 4/2018 | Daudet et al. | |
| 10,161,128 | B2 | 12/2018 | Albartus | |
| 10,407,911 | B2 | 9/2019 | Fenske | |
| 11,078,682 | B1 | 8/2021 | DiGirolamo | |
| 11,118,345 | B2 | 9/2021 | Gstach et al. | |
| 11,286,661 | B2 * | 3/2022 | Gstach | E04C 5/00 |
| 2011/0314764 | A1 | 12/2011 | Basche et al. | |
| 2014/0157718 | A1 | 6/2014 | Fournier et al. | |
| 2016/0305115 | A1 | 10/2016 | Albartua et al. | |
| 2016/0356045 | A1 | 12/2016 | Fenske et al. | |
| 2017/0121963 | A1 * | 5/2017 | Jablonsky | E04B 1/4114 |
| 2021/0404175 | A1 | 12/2021 | Gstach et al. | |

FOREIGN PATENT DOCUMENTS

| | | | |
|---|---|---|---|
| DE | 2058420 | | 6/1972 |
| DE | 2551827 | A1 | 5/1977 |
| DE | 202006018541 | U1 | 2/2007 |
| DE | 202007018210 | U1 | 3/2008 |
| DE | 202007018210 | U1 | 3/2008 |
| DE | 202015002648 | | 12/2015 |
| EP | 0784127 | A1 | 7/1997 |
| EP | 1498564 | A1 | 1/2005 |
| EP | 2907932 | A1 | 8/2015 |
| EP | 3112543 | A1 | 1/2017 |
| EP | 3643847 | A1 | 4/2020 |
| GB | 2265640 | A | 10/1993 |
| GB | 2379226 | A | 3/2003 |
| KR | 20090043027 | A | 5/2009 |
| KR | 20090088106 | A | 8/2009 |
| WO | WO2009083002 | | 7/2009 |
| WO | WO13013876 | A1 | 1/2013 |
| WO | WO 2014044730 | | 3/2014 |

OTHER PUBLICATIONS

Halfen, Anchors for Glazing, 16 pages Feb. 1, 1999, Halfen.
Halfen, Halfen Curtain Wall Support Systems, 1 page, Feb. 1, 2014, Halfen.

* cited by examiner

PROFILE RAIL WITH REINFORCING ELEMENT

This is a Continuation of U.S. patent application Ser. No. 16/633,698 filed Jan. 24, 2020 which is a National Phase Application of PCT/EP2018/069992 filed Jul. 24, 2018 which claims priority to European Patent Application EP 17184148.9, Aug. 1, 2017; all of which are hereby incorporated by reference herein.

The invention relates to a rail assembly, suitable for being cast into concrete, comprising a profile rail having a rail body, the rail body having a first lateral wall, a second lateral wall, a first rail lip which projects from the first lateral wall, and a second rail lip which projects from the second lateral wall. The invention also relates to a building structure comprising a concrete element in which a rail assembly of this kind is embedded.

BACKGROUND

Anchor rails are known, for example from WO13013876 A1, which are cast into a concrete element such that a rail slot of the particular anchor rail emerges. Hammer head elements can be anchored in the anchor rail and thus to the concrete element by means of this rail slot.

WO09083002 A1 discloses an anchor rail which is provided with additional transverse anchors. This is supposed to improve the load-bearing capacity of the anchor rail, in particular in the edge region of a concrete element in the case of high transverse forces. A further anchor rail having transverse anchors is disclosed by EP2907932 A1 (WO14058151 A1).

SUMMARY OF THE INVENTION

The problem addressed by the invention is that of achieving particularly good load values, in particular for transverse loads, in profile rails which are embedded in concrete elements, in a particularly simple and reliable manner.

The present invention provides a rail assembly and a building structure comprising such a rail assembly.

The rail assembly includes a reinforcing element having a force-absorption body, the force-absorption body being arranged in front of the first lateral wall of the profile rail in order for the first lateral wall of the profile rail to contact the force-absorption body, in particular in order to dissipate transverse forces.

A first basic concept of the invention can be considered to be that of stiffening at least the first lateral wall of the profile rail by means of an additional, in particular separate, force-absorption body. This force-absorption body is arranged in front of the first lateral wall of the profile rail on the outside of the rail. When the profile rail is subjected to a transverse load, the first lateral wall of the profile rail can be supported on the force-absorption body such that the transverse load can be transferred over a particularly large area to the surrounding concrete, thus providing a particularly advantageous flow of force. In particular, unwanted small-scale notch loads from the surrounding concrete can be counteracted particularly effectively, which allows for particularly good load absorption. According to the invention, this is ensured by an additional element, namely by the reinforcing element having the force-absorption body. The proven concept of the profile rail can thus be maintained, so that the aforementioned advantages in terms of load behavior can be achieved with particularly low production costs and with compatibility to known systems, and can thus also be achieved with very little installation effort.

The force-absorption body is positioned spatially in front of the first lateral wall of the profile rail, on the outside of the profile rail, i.e. it covers the first lateral wall, namely in such a way that the first lateral wall is in contact with the force-absorption body or at least can come into contact with the force-absorption body, in particular when the profile rail is subjected to a transverse load directed toward the force-absorption body. In the last-mentioned embodiment, there may initially be a gap between the first lateral wall and the force-absorption body, which gap closes when the profile rail is subjected to a transverse load directed toward the force-absorption body.

The first rail lip projects from the first lateral wall, in particular toward the second rail lip, and the second rail lip projects from the second lateral wall, in particular toward the first rail lip. In particular, a rail slot is formed between the two rail lips, through which a hammer head element, for example a hammer head screw or a slot nut, can be inserted into the profile rail and then secured by rotation on the rail lips. The first lateral wall and the second lateral wall expediently extend in parallel with one another. In particular, the first lateral wall and the second lateral wall are connected by a rail bottom, which may be level in the simplest case, but which may also have more complex geometries such as a V-shape. Preferably, at least the force-absorption body, particularly preferably the entire reinforcing element, is made of metal. The profile rail is also preferably made of metal.

It is particularly preferable for the force-absorption body to be arranged in front of the first lateral wall of the profile rail over a length of at least 50%, 75% or 90% of the length of the profile rail in order for the first lateral wall of the profile rail to contact the force-absorption body. Accordingly, contact between the first lateral wall and the force-absorption body is possible over a significant part of the length of the profile rail, meaning there is a dissipation of transverse forces over a particularly large area, which is thus advantageous. The force-absorption body may also completely overlie the first lateral wall, i.e. the force-absorption body may be arranged in front of the first lateral wall over a length of at least 100% or more of the length of the profile rail in order for the first lateral wall of the profile rail to contact the force-absorption body. For this purpose, the force-absorption body is expediently at least as long as the rail body. The length of the profile rail can be understood in a manner conventional in the art as its extension along its longitudinal axis and/or its extension along the rail slot and/or its extension perpendicular to the transverse direction.

Expediently, the force-absorption body has a contact surface for the first lateral wall of the rail body, which surface corresponds geometrically to the outer surface of the first lateral wall, allowing for particularly homogeneous force transmission. If the outer surface of the first lateral wall is level, this contact surface can in particular extend in parallel with the outer surface of the first lateral wall.

The force-absorption body may preferably be a plate, which can allow a particularly good transmission of force and/or a particularly low production cost. This plate preferably extends in parallel with the first lateral wall of the rail body. In principle, however, the force-absorption body could also be a rod, for example, which may also be advantageous in terms of production.

Furthermore, it is expedient for the reinforcing element to have at least one reinforcing rib which protrudes from the force-absorption body, preferably designed as a plate, and preferably protrudes at a right angle. In particular, the reinforcing rib protrudes from the profile rail away from the force-absorption body. By means of a reinforcing rib, the force-absorbing capacity of the force-absorption body can be further improved and/or a particularly good transmission of force into the surrounding concrete is made possible in a particularly simple manner. The force-absorption body and the reinforcing rib expediently form an L-shape. Preferably, the force-absorption body and the reinforcing rib are integral, which can further reduce the production cost.

The reinforcing rib is preferably the same length as the force-absorption body, which can be advantageous in terms of force absorption. Expediently, the reinforcing rib is arranged at an end of the force-absorption body, which can offer advantages in terms of forces and production.

It is particularly preferred for the reinforcing rib to extend in a plane spanned by the rail lips. In particular, the reinforcing rib lies in this plane. Accordingly, the reinforcing rib is arranged at the level at which transverse forces are introduced into the rail body during operation, which allows for particularly good force absorption. The rail slot is also located in the plane spanned by the rail lips.

In a further preferred embodiment of the invention, the rail assembly comprises at least one force-dissipating rod which is connected to the reinforcing element, in particular in order to introduce tensile forces from the reinforcing element into the force-dissipating rod. In particular, the connection between the reinforcing element and the force-dissipating rod is established in addition to the embedding of these two elements in the concrete, i.e. is already established before the rail assembly is cast into the concrete. Particularly preferably, the connection between the reinforcing element and the force-dissipating rod is established at the force-absorption body of the reinforcing element. Such a force-dissipating rod, which is preferably made of metal, is particularly advantageous in a near-edge arrangement of the rail assembly in the concrete element, since the force-dissipating rod can relieve the load on the edge of the concrete element and thus effectively counteract an unwanted, premature breakout of the concrete element near the edge. Expediently, the at least one force-dissipating rod intersects the rail body, in particular when viewed in the direction of the rail slot and/or in the direction perpendicular to the plane spanned by the rail lips. Preferably, the force-dissipating rod is integrally bonded to the reinforcing element. For example, the force-dissipating rod and the reinforcing element can be interconnected by a welded connection. The force-dissipating rod can also be integral with at least one part of the reinforcing element, in particular integral with the force-absorption body.

The rail assembly preferably comprises a plurality of force-dissipating rods which are advantageously arranged as explained above. The force-dissipating rods can in particular extend in parallel with one another.

The profile rail can be designed in particular as an anchor rail and, accordingly, for particularly good anchorage in concrete, can comprise a plurality of anchors which project on the rail body, in particular from the rail bottom thereof. For a particularly compact embodiment which is particularly advantageous in terms of forces, the at least one force-dissipating rod can pass between two adjacent anchors.

To enable, inter alia, particularly simple and reliable positioning, it is particularly advantageous for the reinforcing element to be connected to the profile rail. In particular, the connection between the reinforcing element and the profile rail is established in addition to the embedding of these two elements in the concrete, i.e. is already established before the rail assembly is cast into the concrete, thus is already established on the rail assembly suitable for being cast into concrete. The connection between the reinforcing element and the profile rail can be established for example at the anchors or at the rail bottom of the rail body.

The invention also relates to the intended use of the rail assembly, and thus in particular to a building structure comprising a concrete element in which a rail assembly according to the invention is embedded, in particular cast. In particular, the rail assembly is embedded in the concrete element such that the rail slot of the rail body emerges on a surface of the concrete element. In particular, the rail assembly can be arranged in the vicinity of an edge of the concrete element, since such an arrangement can place particularly high demands on the transverse load behavior. Preferably, the rail body of the rail assembly is arranged in parallel with the edge of the concrete element.

It is particularly preferred for the reinforcing element, in particular its reinforcing rib, to emerge on a surface of the concrete element, in particular on the same surface on which the rail body also emerges, in particular via its rail slot. As a result, the introduction of force into the concrete can be further improved and/or the assembly and/or production can be further simplified.

Features which are explained in connection with the rail assembly according to the invention can also be used in the building structure according to the invention, and, conversely, features which are explained in connection with the building structure according to the invention can also be used in the rail assembly according to the invention.

BRIEF DESCRIPTION OF THE DRAWINGS

The invention is explained in greater detail in the following with reference to preferred embodiments, which are shown schematically in the accompanying drawings, it being possible to implement individual features of the embodiments disclosed in the following in principle individually or in any desired combination within the context of the invention. In the drawings, shown schematically.

Elements having the same function are identified in the figures with the same reference numerals.

DETAILED DESCRIPTION

Figure 1:
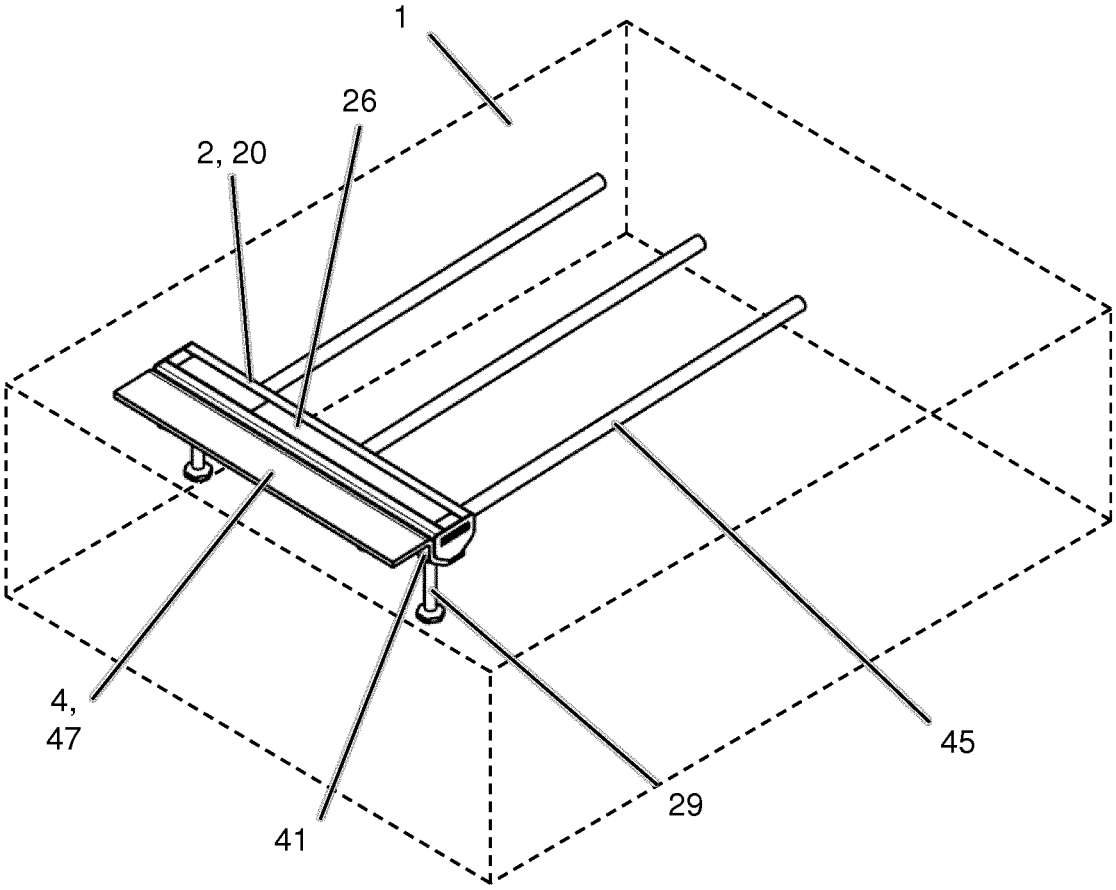
FIG. 1: is a perspective view of a building structure according to the invention with a first embodiment of a rail assembly according to the invention.
Figure 2:
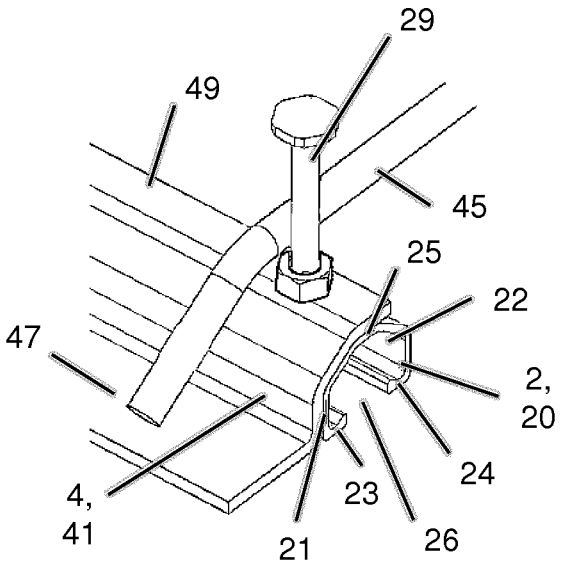
FIG. 2: is a perspective detailed view of the underside of the rail assembly from FIG. 1.
Figure 3:
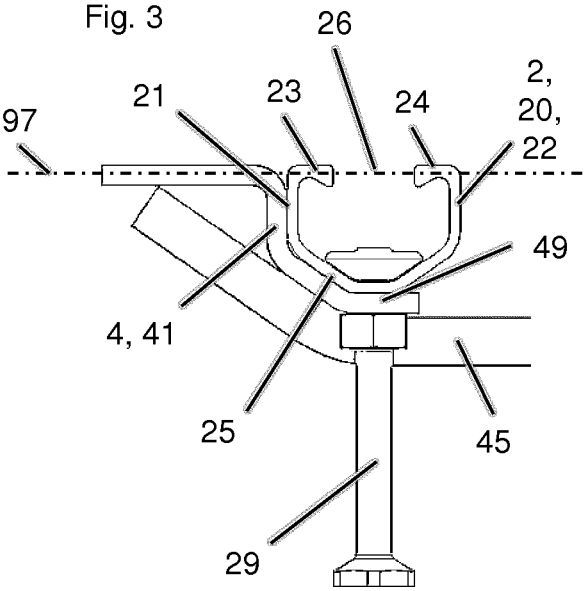
FIG. 3: is a detailed side view of the rail assembly from FIG. 1.

A first embodiment of a rail assembly according to the invention is shown in FIGS. 1 to 3; in FIG. 1 as part of a building structure according to the invention.

The rail assembly comprises a profile rail 2 and a reinforcing element 4 for the profile rail 2. The profile rail 2 comprises a rail body 20 having a first lateral wall 21, a second lateral wall 22, a first rail lip 23, a second rail lip 24 and a rail bottom 25. The first rail lip 23 is arranged at an upper end of the first lateral wall 21 and a second rail lip 24 is arranged at an upper end of the second lateral wall 22, the first rail lip 23 projecting from the first lateral wall 21 toward the second lateral wall 22 and the second rail lip 24 projecting from the second lateral wall 22 toward the first lateral wall 21. A rail slot 26 is formed between the two rail lips 23 and 24. A hammer head element can be inserted into the interior of the rail body 20 through said rail slot 26 and can be secured there by rotation on the rail lips 23 and 24. The rail bottom 25 connects the two lateral walls 21 and 22 on the underside of the rail. In the embodiment shown, the two lateral walls 21 and 22 extend in parallel with one other and the rail bottom 25 is V-shaped. In principle, however, other embodiments are also conceivable, for example with a level rail bottom.

The profile rail 2 is designed as an anchor rail and as such comprises a plurality (in this case two) of anchors 29 which protrude downwards from the rail body 20. In the present embodiment, the anchors 29 are arranged on the rail bottom 25 by way of example, but other, for example lateral, arrangements are also conceivable.

The reinforcing element 4 is used to transversely reinforce the first lateral wall 21 and the first rail lip 23 of the profile rail 2. The reinforcing element 4 comprises a planar force-absorption body 41 which is arranged immediately in front of the first lateral wall 21 for contact with the first lateral wall 21. In the embodiment shown, the force-absorption body 41 is substantially the same length as the first lateral wall 21 and thus the profile rail 2. The reinforcing element 4 further comprises a reinforcing rib 47 which protrudes, at the top of the force-absorption body 41, rectilinearly from the force-absorption body 41, in particular away from the rail body 20. The planar reinforcing rib 47 lies in particular in a plane 97 spanned by the rail lips 23 and 24. The rail slot 26 also lies in this plane 97. The reinforcing rib 47 and the force-absorption body 41 are integral here, by way of example.

The rail assembly further comprises a plurality (in this case three) of force-dissipating rods 45 which are indirectly or directly connected to the reinforcing element 4, in particular to the force-absorption body 41 thereof. Said force-dissipating rods 45 extend approximately in parallel with one another and intersect the rail body 20 beneath the rail bottom 25, preferably at right angles.

In the embodiment shown, the reinforcing element 4 further comprises an eyelet element 49, by means of which the reinforcing element 4 is attached to the profile rail 2. Said eyelet element 49 is arranged on the force-absorption body 41 and has at least one passage through which an anchor 29 is guided. By means of a nut screwed onto the anchor 29, the eyelet element 49 is pressed against the rail body 20. As a result, the eyelet element 49 and thus the reinforcing element 4 is secured to the profile rail 2. In the embodiment shown, the eyelet element 49 is formed as an angled plate that is integral with the force-absorption body 41. In principle, however, other embodiments of the eyelet element 49 are also conceivable or, as shown for example in FIG. 4, embodiments without an eyelet element 49 are conceivable.

The rail assembly can be cast into a concrete element 1 in the building structure shown in FIG. 1. The rail assembly is in this case arranged such that the rail lips 23 and 24, the rail slot 26 and the reinforcing rib 47 emerge on the same surface of the concrete element 1. The anchor 29 and the at least one force-dissipating rod 45 are embedded in the concrete element 1.

If, in the building structure shown in FIG. 1, transverse forces occur in the first rail lip 23 in the direction of the first lateral wall 21, these can be at least partially diverted from the first lateral wall 21 to the force-absorption body 41 resting against the first lateral wall 21, the reinforcing element 4 reinforcing the force-absorption body 41. The force-dissipating rods 45 allow at least partial introduction of the dissipated forces deep into the concrete element 1, as a result of which the load on the edge of the concrete element 1 lying in front of the profile rail 2 and the reinforcing element 4 can be relieved.

The other embodiments shown in the figures are based substantially on the embodiment in FIGS. 1 to 3, and therefore only the substantial differences will be discussed below.

Figure 4:
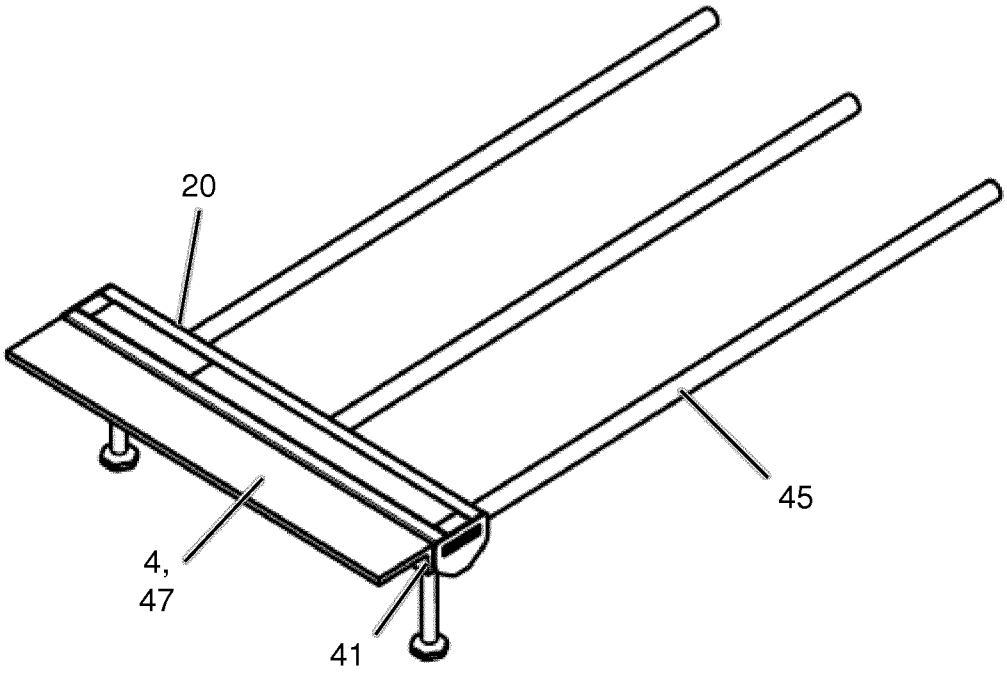
FIG. 4: shows a second embodiment of a rail assembly according to the invention.

The embodiment of FIG. 4 is a modification of the embodiment of FIGS. 1 to 3, in which the eyelet element 49 is missing. In contrast with the embodiment of FIGS. 1 to 3, in which the reinforcing element 4 is Z-shaped, the reinforcing element 4 is L-shaped in the embodiment of FIG. 4.

Figure 5:
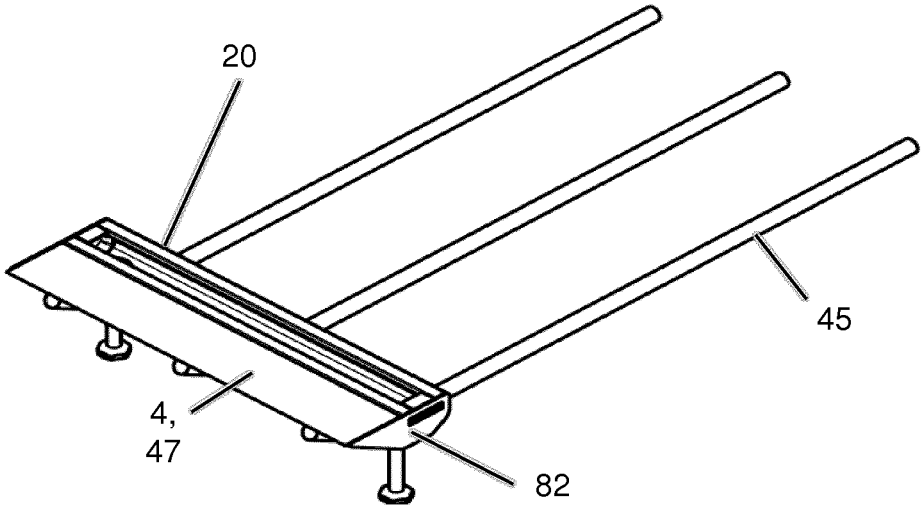
FIGS. 5 and 6: show a third embodiment of a rail assembly according to the invention, which is an exploded view in FIG. 6.
Figure 6:
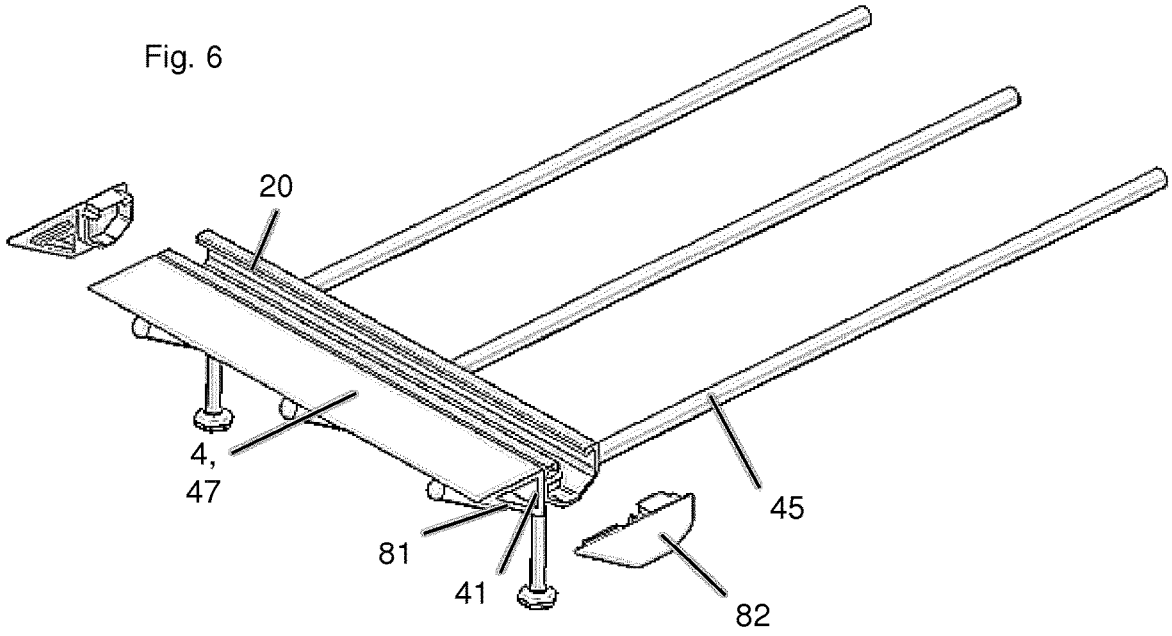

In the embodiment of FIGS. 5 and 6, the reinforcing element 4 has an additional rib 81 which connects the force-absorption body 41 and the reinforcing rib 47 such that the additional rib 81, the force-absorption body 41 and the reinforcing rib 47 form a triangular hollow profile. The reinforcing element 4 can in this case be attached to the profile rail 2 via end caps 82 which engage in the interior of the rail body 20 and in the triangular hollow profile of the reinforcing element 4.

Figure 7:
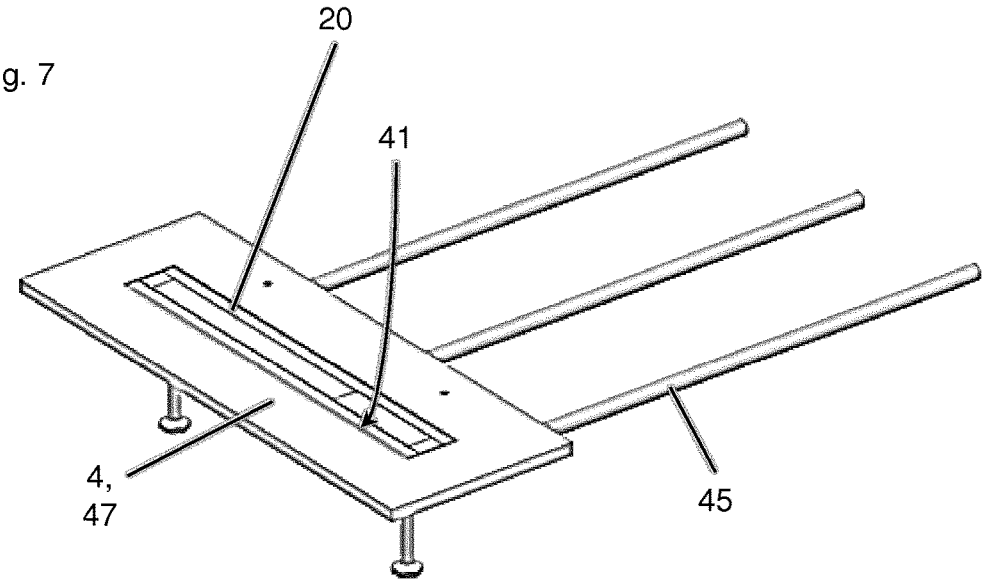
FIG. 7: shows a fourth embodiment of a rail assembly according to the invention.

In the embodiment of FIG. 7, the reinforcing element 4 is designed as an annular plate which surrounds the rail body 20.

Figure 8:
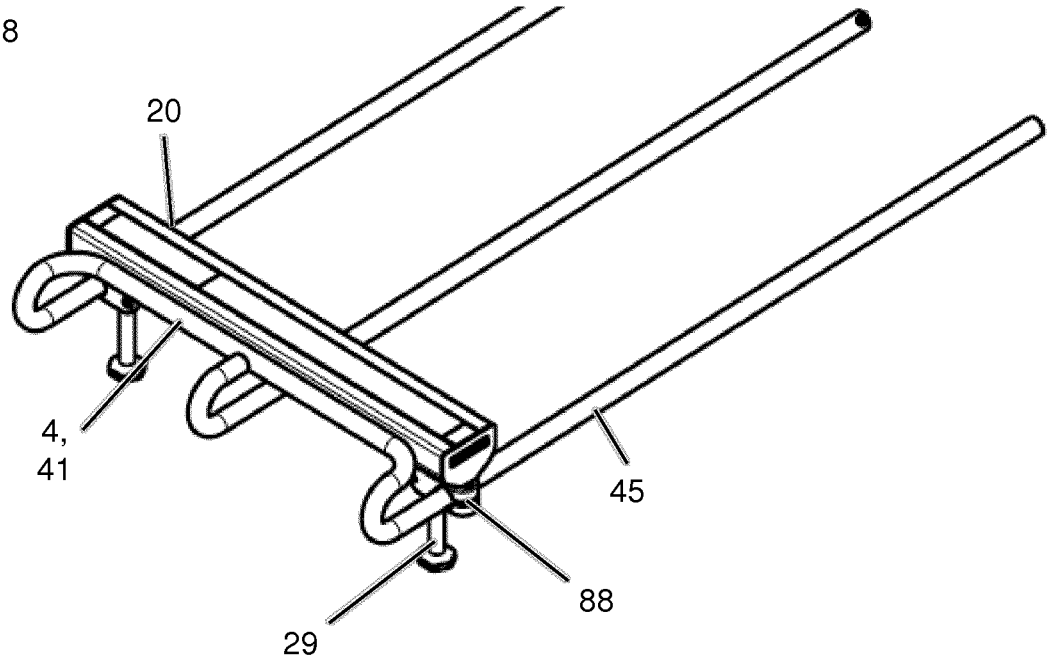
FIG. 8: shows a fifth embodiment of a rail assembly according to the invention.

In the embodiment of FIG. 8, the force-absorption body 41 is formed as a rod which is integral with two force-dissipating rods 45. The reinforcing element 4 is connected to the profile rail 2 by means of clamps 88 which each act on a force-dissipating rod 45 and an anchor 29.

Figure 9:
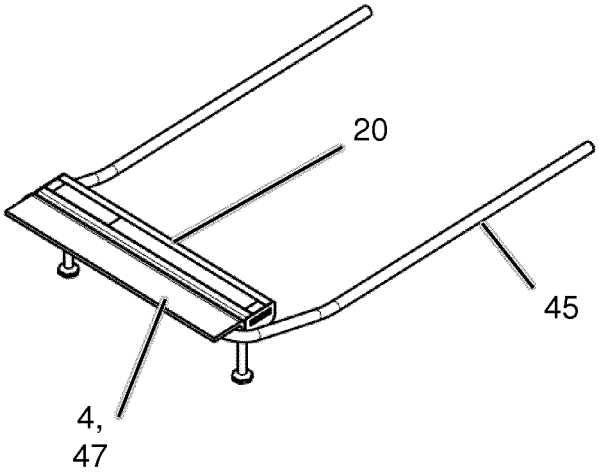
FIG. 9 shows a sixth embodiment of a rail assembly according to the invention.

The embodiment of FIG. 9 is based on the embodiment of FIG. 4, but the force-dissipating rods 45 are designed differently. In particular, in the embodiment of FIG. 9 two force-dissipating rods 45 are provided which form the legs of a U-profile into which the reinforcing element 4 is centrally inserted.

What is claimed is:

1. A rail assembly, suitable for being cast into concrete, comprising:

a profile rail having a rail body, the rail body having a first lateral wall, a second lateral wall, a first rail lip projecting from the first lateral wall, and a second rail lip projecting from the second lateral wall;

a reinforcing element having a force-absorption body, the force-absorption body being arranged in front of the first lateral wall of the profile rail over a length of at least 50% of the length of the profile rail in order for the first lateral wall of the profile rail to contact the force-absorption body, the reinforcing element including at least one reinforcing rib protruding on a first lateral wall side of the rail body perpendicularly to the force-absorption body in a plane spanned by the first and second rail lips; and at least one force-dissipating rod connected to the reinforcing element and extending perpendicularly to a plane of the first lateral wall on a second lateral wall side of the rail body, the at least one force dissipating rod not extending beyond the reinforcing rib on the first lateral wall side of the rail body.

2. The rail assembly as recited in claim 1 wherein the force-absorption body is a plate.

3. The rail assembly as recited in claim 1 wherein the profile rail includes a plurality of anchors projecting on the rail body.

4. The rail assembly as recited in claim 1 wherein the reinforcing element is connected to the profile rail.

5. The rail assembly as recited in claim 1 wherein the force-absorption body has a same length as the first lateral wall.

6. The rail assembly as recited in claim 1 wherein the at least one force-dissipating rod includes at least two force-dissipating rods connected to the reinforcing element.

7. The rail assembly as recited in claim 1 wherein the at least one force-dissipating rod includes at least three force-dissipating rods connected to the reinforcing element.

8. The rail assembly as recited in claim 1 wherein the at least one force-dissipating rod is directly connected to the force-absorption body.

9. The rail assembly as recited in claim 1 wherein the rail body has a rail bottom, the at least one force-dissipating rod intersecting the rail body beneath the rail bottom.

10. The rail assembly as recited in claim 1 wherein the at least one force-dissipating rod intersects the rail body beneath the rail bottom perpendicularly to a lengthwise direction of the rail body.

11. The rail assembly as recited in claim 1 wherein the reinforcing element has an eyelet element arranged on the force absorption element.

12. The rail assembly as recited in claim 11 wherein the eyelet element contacts the rail bottom.

13. The rail assembly as recited in claim 12 wherein the profile rail includes an anchor projecting on the rail body and the eyelet element has at least one passage for the anchor.

14. A building structure comprising a concrete element and the rail assembly as recited in claim 1, the rail assembly being embedded in the concrete element.

15. The building structure as recited in claim 14 wherein the reinforcing element emerges on a surface of the concrete element.

16. A method for creating the building structure as recited in claim 14 comprising: embedding the rail assembly in concrete.

17. The method as recited in claim 16 wherein the reinforcing element emerges on a surface of the concrete.

* * * * *